US006872172B2

(12) United States Patent
Wang et al.

(10) Patent No.: US 6,872,172 B2
(45) Date of Patent: Mar. 29, 2005

(54) INTERACTIVE BOXING TRAINER

(76) Inventors: Leao Wang, No. 1, Lane 233, Sec. 2, Charng Long Rd., Taiping (TW), 411; Peter Wu, No. 1, Lane 233, Sec. 2, Charng Long Rd., Taiping (TW), 411

( * ) Notice: Subject to any disclaimer, the term of this patent is extended or adjusted under 35 U.S.C. 154(b) by 308 days.

(21) Appl. No.: 10/315,257

(22) Filed: Dec. 10, 2002

(65) Prior Publication Data

US 2004/0110605 A1 Jun. 10, 2004

(51) Int. Cl.[7] ..... A63B 69/02

(52) U.S. Cl. ..... 482/83; 482/4; 482/8; 482/87

(58) Field of Search ..... 482/83–90; 473/441–445, 473/438, 422; 482/4, 8, 12

(56) References Cited

U.S. PATENT DOCUMENTS 4,030,731 A * 6/1977 Delcayre ..... 463/47.1
4,401,303 A * 8/1983 Anderson et al. ..... 482/4
4,771,394 A * 9/1988 Cavanagh ..... 702/160
5,723,786 A * 3/1998 Klapman ..... 73/379.04
5,844,861 A * 12/1998 Maurer ..... 368/10

* cited by examiner

*Primary Examiner*—Jerome W. Donnelly
(74) *Attorney, Agent, or Firm*—Kuo-Hsiung Chiu

(57) ABSTRACT

The present invention relates to an interactive boxing trainer which includes a main body, a driving unit, a control unit and a pair of boxing gloves with a respective signal transmitter. The main body contains a longitudinal slide rail, a lateral slide rail and a punched body. The punched body is driven by the driving unit and movable on the longitudinal slide rail and the lateral slide rail. Moreover, the control unit is in connection with a plurality of signal receivers provided at the upper and lower part of the main body so as to receive signals sent by the signal transmitters on the boxing gloves. Therefore, the position, speed and travelling path of the boxing gloves can be detected and processed by the control unit which then commands the driving unit to move the punched body away from the approaching punching glove.

1 Claim, 1 Drawing Sheet

INTERACTIVE BOXING TRAINER

BACKGROUND OF THE INVENTION

1. Fields of the Invention

The present invention relates to an interactive boxing trainer, and more particularly, to a device which automatically detects and escapes from boxing gloves to improve the training effect and enhance the training fun.

2. Description of the Prior Art

The conventional boxing exercisers belong to "in-place" device (i.e. punching bag) for boxing training. The punching bag is suspended so that it swings to and fro by being punched with fists of operators. Therefore, the operator has to watch its swinging position and speed to give the next punching so as to achieve a certain training effect. In practice of the basic boxing defense, both boxers duly dodge in accordance with the punching position and timing of the opponent. However, the attacking side has to grasp the attack opportunity unlike the easy practice on the punching bag.

In order to carry out "interactive practice" to command the punching timing and skills, all boxers have to employ one of their caliber to simulate the boxing match.

In consideration of many objective factors such as expenses, time, possible injuries, it's rare for common boxers to employ the so-called "interactive practice". Particularly, the beginners can hardly command the basic punching timing and boxing skills without the interactive practice, let alone imagine the real situation in the boxing match beforehand.

SUMMARY OF THE INVENTION

Therefore, it is a primary object of the present invention to eliminate the above-mentioned drawbacks and to provide an interactive boxing trainer which utilizes the modern technique of automatic detection and automatic control for command of the position, the speed and the travelling path of the boxing gloves. Moreover, the instant shift of the automatic driving unit will keep the punched body away from the approaching boxing gloves. Therefore, the boxer should use special skills (rapid movement of the feet, rapid punching of the fists, continuous punching, deceiving punching or punching according to the movement direction of the punched body) before or during punching so as to exactly strike the punched body. Therefore, the punching difficulty is increased and the punching skills are achieved. Furthermore, the trainee won't be injured by counterattack, and he can make practice without the time restriction.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 2:
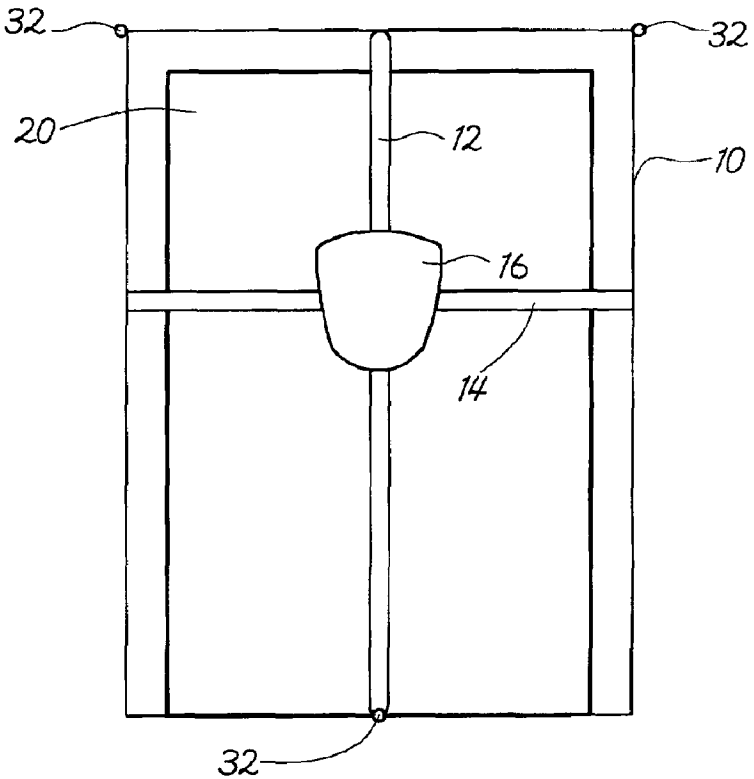
FIG. 2 is a front view of the preferred embodiment of the present invention.
Figure 1:
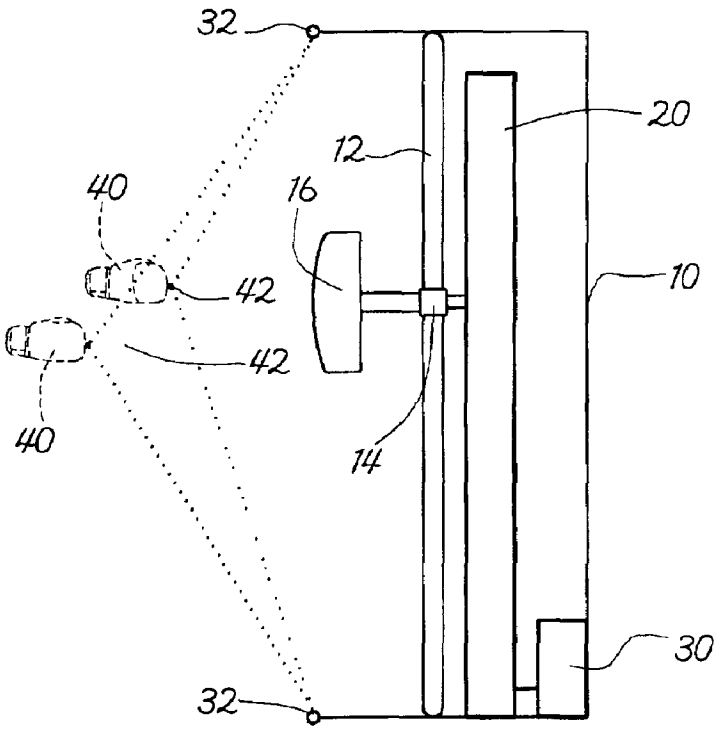
FIG. 1 is a side view of a preferred embodiment of the present invention.

First of all, referring to FIGS. 1 and 2, a preferred embodiment of the present invention is shown. From the figures, the interactive boxing trainer includes a main body

10, a driving unit 20, a control unit 30 and a pair of boxing gloves 40 with a respective signal transmitter 42. The main body 10 contains a longitudinal slide rail 12, a lateral slide rail 14 and a punched body 16. The punched body 16 is driven by the driving unit 20 and movable on the longitudinal slide rail 12 and the lateral slide rail 14. Moreover, the control unit 30 is in connection with a plurality of signal receivers 32 provided at the upper and lower part of the main body 10 so as to receive signals sent by the signal transmitters 42 on the boxing gloves 40. Therefore, the position, speed and travelling path of the boxing gloves 40 can be detected and processed by the control unit 30 which then commands the driving unit 20 to move the punched body 16 away from the approaching punching glove 40.

In order to effectively distinguish the right and left boxing gloves 40, both signal transmitters 42 give out different frequency signals, while the relative distance between respective boxing gloves 40 and the punched body 16 can be reckoned by the signal receivers 32 in accordance with the different frequency. Thereafter, the control unit 30 gives command to the driving unit 20 to proceed with further proper reaction. Besides, pairwise signal receivers 32 can be arranged to detect different signals given out by the signal transmitters 42 of both boxing gloves 40, respectively, so as to fulfill the aforementioned function. This technique belongs to the prior art so that no further descriptions thereto are given hereinafter. Furthermore, how the control unit 30 operates the driving unit 20 and in which direction and how much the punched body 16 are moved to keep away from the boxing gloves 40 belong to the programming field so that no further descriptions thereto are given hereinafter.

In brief, the control unit 30 of the present invention makes use of at least two pairs of signal receivers 32 at the top and bottom and both signal transmitters 42 to exactly measure the position, the speed and the traveling path. Accordingly, dual positioning method is used for a more accurate processing. Besides, the driving unit 20 laterally (X-axis) and longitudinally (Y-axis) shift the punched body 16 to simulate the dodge movement of the opponent in the boxing match. Certainly, the punched body 16 can be arranged to move forward and backward (Z-axis) when required.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claim.

What is claimed is:

1. A interactive boxing trainer comprising:

a driving unit;

a main body having a longitudinal slide rail, a lateral slide rail and a punched body, said punched body being driven by said driving unit and movable on said longitudinal slide rail and said lateral slide rail;

a control unit being in connection with a plurality of signal receivers provided at the upper and lower part of said main body so as to receive signals sent by signal transmitters on boxing gloves; and a pair of boxing gloves with a respective signal transmitter;

so that the position, speed and travelling path of said boxing gloves can be detected and processed by said control unit which then commands said driving unit to move said punched body away from said approaching punching glove.

* * * * *